United States Patent [19]

Matsuda

[11] 4,442,685

[45] Apr. 17, 1984

[54] SLIDE FASTENER STRINGER FOR KNIT FABRICS

[75] Inventor: Nyuzen Matsuda, Nyuzen, Japan

[73] Assignee: Yoshida Kogyo K. K., Tokyo, Japan

[21] Appl. No.: 223,201

[22] Filed: Jan. 7, 1981

[30] Foreign Application Priority Data

Jun. 25, 1980 [JP] Japan ..... 55-89252[U]

[51] Int. Cl.[3] ..... D04B 23/08

[52] U.S. Cl. ..... 66/193; 66/195

[58] Field of Search ..... 66/192, 190, 193, 195; 24/205.16 R, 205.16, 205.1 C

[56] References Cited

U.S. PATENT DOCUMENTS

| | | | |
|---|---|---|---|
| 3,983,721 | 10/1976 | Matsuda | 66/195 |
| 4,014,190 | 3/1977 | Terada et al. | 66/195 |
| 4,125,911 | 11/1978 | Moertel | 5/468 |
| 4,142,276 | 3/1979 | Heimberger | 66/195 |
| 4,265,003 | 5/1981 | Marsuda | 66/195 |
| 4,291,440 | 9/1981 | Yoshida | 24/205.16 R |

FOREIGN PATENT DOCUMENTS

| | | | |
|---|---|---|---|
| 752781 | 12/1976 | Belgium | 139/383 B |
| 51-135709 | 11/1976 | Japan . | |
| 52-24161 | 2/1977 | Japan . | |

*Primary Examiner*—Ronald Feldbaum

*Attorney, Agent, or Firm*—Hill, Van Santen, Steadman & Simpson

[57] ABSTRACT

A slide fastener stringer has a warp-knit stringer tape including a pair of longitudinal warp-knit webs spaced transversely from each other with a wale-free region therebetween and interconnected by a connecting thread having substantially parallel spaced portions extending transversely across the wale-free region, thereby defining a plurality of substantially rectangular openings longitudinally along the wale-free region. The slide fastener stringer is attached to a knit fabric of wool yarn by a row of loops constituted by a course of the knit fabric and looped respectively around the parallel portions of the connecting thread. Alternatively, a row of loops extending through the knit fabric along a wale thereof into the rectangular openings are interlooped by chain stitches, thereby connecting the stringer and the knit article together. The loops and chain stitches are made of wool yarn that is substantially as stretchable as the knit fabric.

12 Claims, 6 Drawing Figures

SLIDE FASTENER STRINGER FOR KNIT FABRICS

BACKGROUND OF THE INVENTION

1. Field of the Invention

The present invention relates to a slide fastener stringer for use on a knit fabric such as sweater or cardigan, and a knit article having a slide fastener as used in a a closure.

2. Prior Art

Slide fasteners are normally fastened by sewing machines with sewing threads to knit garments such as sweaters, cardigans, or the like. Since the knit garments are far more stretchable than the slide fasteners, the latter as attached becomes puckered or wavy under stresses as the knit fabrics shrink, with the result that the knit garments with slide fasteners attached are likely to become unsightly. Slide fasteners have therefore found limited use as a closure on knit garments.

SUMMARY OF THE INVENTION

A slide fastener stringer comprises a warp-knit stringer tape including a pair of longitudinal warp-knit webs spaced transversely from each other with a wale-free region left therebetween, one of the warp-knit webs being narrower than the other web which supports a row of coupling elements thereon. The warp-knit webs are laterally interconnected by a thread having substantially parallel portions extending transversely across the wale-free region and spaced longitudinally at an equal interval, thereby defining a plurality of substantially rectangular openings longitudinally along the wale-free region. The slide fastener stringer is attached to a knit fabric of wool yarn or similar yarn by a row of loops constituted by a course of the knit fabric and looped respectively around the parallel portions of the connecting thread. Alternatively, a row of loops extending through the knit fabric along a wale thereof into the rectangular openings are interlooped by chain stitches, thereby connecting the stringer and the knit fabric together. The loops and chain stitches are made of wool yarn or similar yarn that is substantially as stretchable as the knit fabric.

It is an object of the present invention to provide a slide fastener stringer which is attachable to a knit fabric of wool yarn or similar yarn so that the fastener as attached is less subjected to getting puckered or wavy.

Another object of the present invention is to provide a slide fastener stringer which can be either knit into a knit garment of wool yarn at the time of the latter's being knit or attached to a knit garment by stitching.

Still another object of the present invention is to provide a slide fastener stringer which can be knit into a knit garment of wool yarn smoothly on a knitting machine.

Still another object of the present invention is to provide a slide fastener stringer which can be sewn to a knit fabric of wool yarn with stitches of wool yarn.

Still another object of the present invention is to provide a knit article having a slide fastener attached to a knit fabric of wool yarn, which fastener has means for damping forces applied from the knit fabric to the fastener.

Many other objects, advantages and features of the present invention will become manifest to those versed in the art upon making reference to the detailed description and the accompanying sheets of drawings in which preferred structural embodiments incorporating the principles of the present invention are shown by way of illustrative example.

BRIEF DESCRIPTON OF THE DRAWINGS

Figure 1:
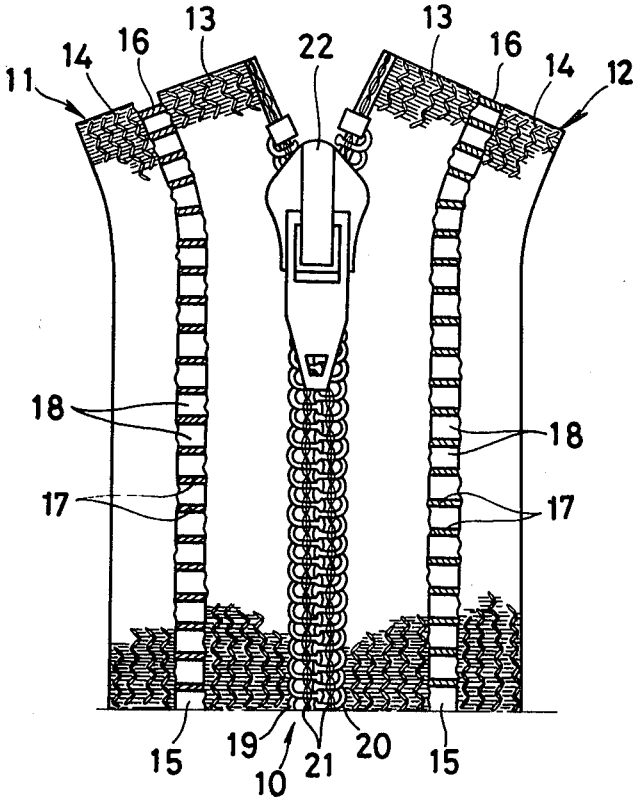
FIG. 1 is a fragmentary front elevational view of a slide fastener including a pair of slide fastener stringers according to the present invention.
Figure 4:
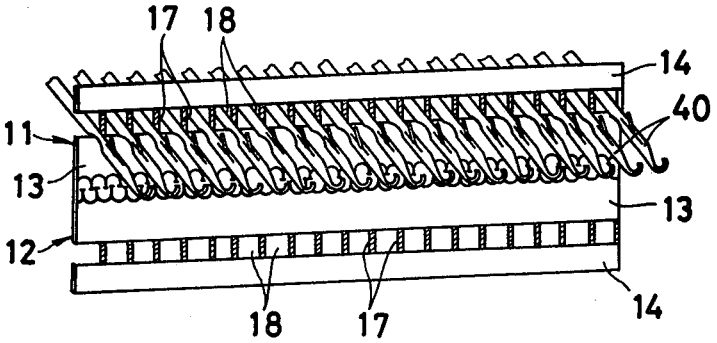
Figure 5:
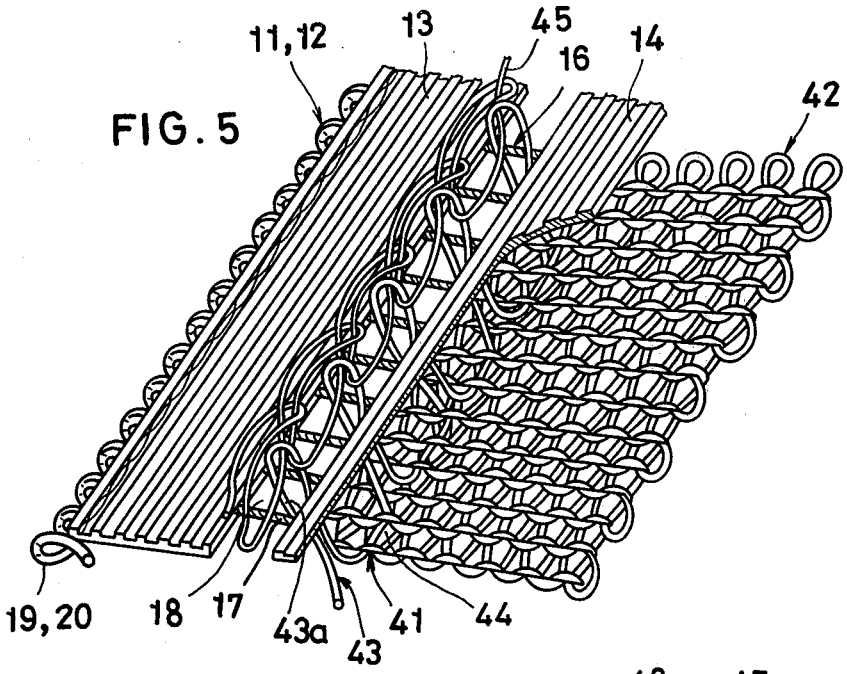
Figure 6:
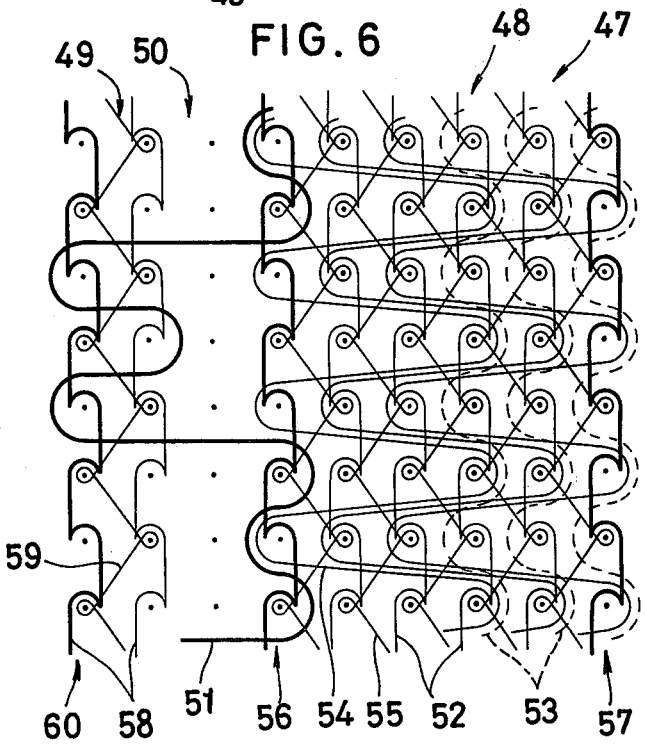

FIG. 4, appearing with FIG. 1, is a perspective view illustrative of the way in which a slide fastener is knit into a knit fabric on a knitting machine;

FIG. 5 is a fragmentary perspective view, partly broken away, of a slide fastener stringer stitched to a knit fabric; and FIG. 6 is a diagram showing lapping movements for a warp-knit stringer tape according to another embodiment.

DETAILED DESCRIPTION

The principles of the present invention are particularly useful when embodied in a slide fastener such as shown in FIG. 1, generally indicated by the numeral 10. The slide fastener 10 comprises a pair of slide fastener stringer tapes 11,12 each including a pair of longitudinally extending, parallel warp-knit webs 13,14 and a longitudinal wale-free region 15 interposed between the webs 13,14. The warp-knit webs 13,14 are interconnected transversely by a connecting thread 16 having ladder-like parallel portions 17 extending transversely cross the wale-free region 15 in a direction substantially perpendicular to the webs 13,14, thereby providing a plurality of substantially rectangular openings 18 longitudinally along the wale-free region 15.

A pair of rows of coupling elements 19,20 each in the form of a helically coiled monofilament is supported by sewing threads 21 respectively on and along confronting longitudinal edges of the webs 13,13. The slide fastener 10 can be opened and closed by a slider 22 movable along the rows of coupling elements 19,20 to take them into and out of interdigitating engagement with each other.

Figure 2:
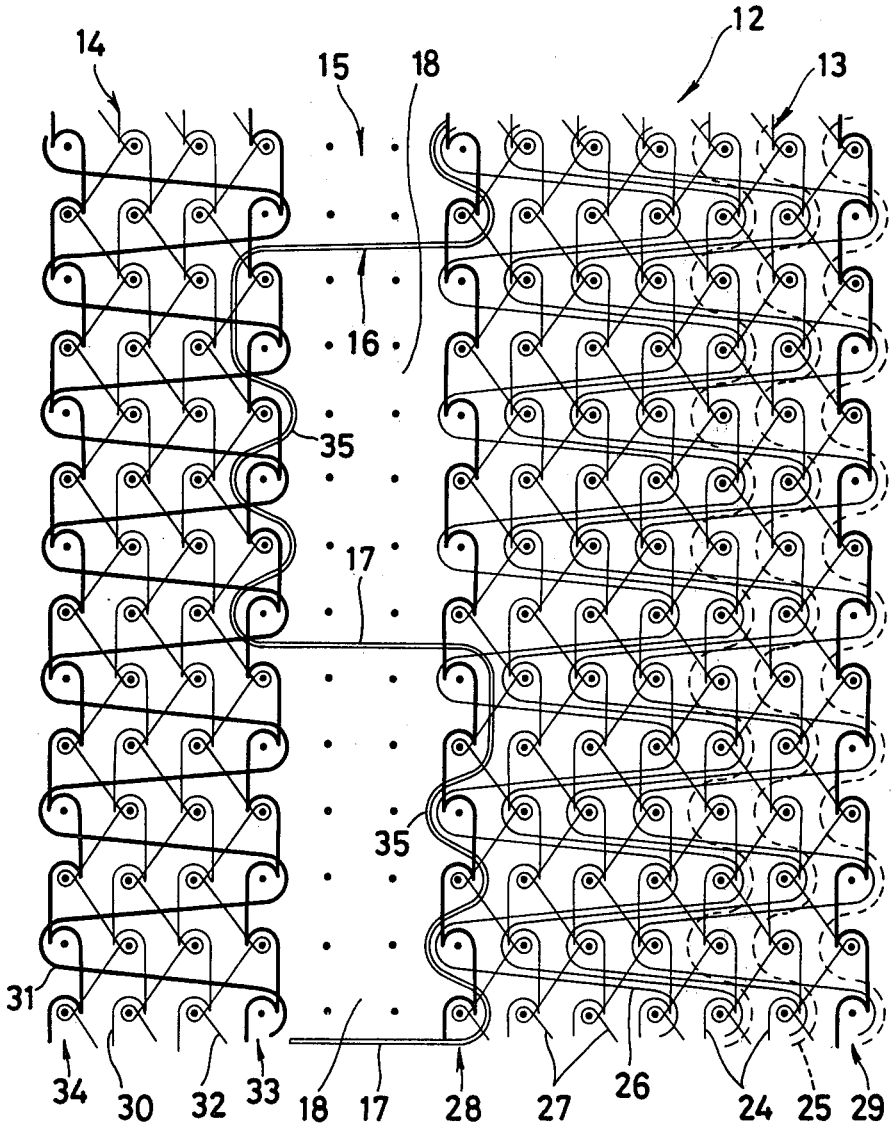
FIG. 2 is a diagram showing lapping movements for a warp-knit stringer tape according to one embodiment.

As shown in FIG. 2, each of the warp-knit webs 13,13 is composed of a first group of foundation threads 24 knitted as chain stitches in a pattern of 1-0/0-1, a second group of foundation threads 26 laid in coursewise in a pattern of 0-0/4-4, and a third group of foundation threads 27 knitted in a pattern of 1-2/1-0, the foundation threads 24,26,27 constituting a plurality of longitudinal wales juxtaposed across the web 13,13. The web 13 also includes a fourth group of three foundation threads 25 laid in warpwise in a pattern of 0-0/1-1 which reinforce the marginal edge of the web 13 on which the coupling elements are mounted. The first foundation threads 24 that constitute outermost wales 28,29 of the web 13 are thicker than the other foundation threads to make the wales 28,29 more rigid that the other wales.

Each of the warp-knit webs 14,14 is composed of a fifth group of foundation threads 30 knitted as chain stitches in a pattern of 1-0/0-1, a sixth foundation thread 31 laid in coursewise in a pattern of 0-0/4-4, and a seventh group of foundation threads 32 knitted in a pattern of 1-2/1-0, the foundation threads 30–32 constituting a plurality of longitudinal wales juxtaposed across the web 14. The web 14 is composed of four wales in the illustrated embodiment and is narrower than the web 13. The web 14 should comprise four wales or fewer. The fifth foundation threads 30 and the sixth foundation thread 31 that constitute the outermost wales 33,34 of the web 14 are thicker than the other foundation threads to make the wales 33,34 more rigid than the other wales. The wale-free region 15 is devoid of two wales in the illustrated embodiment, but may be devoid of one to four wales as desired. The connecting thread 16 is laid across the wale-free region 15 in a pattern of 0-0/1-1/0-0/1-1/0-0/0-0/4-4/3-3/4-4/3-3/4-4/4-4 so that the connecting thread 16 also includes portions 35 laid longitudinally only in the marginal wales 28,33 of the webs 13,14 and cooperating with the parallel portions 17 to connect the wales 28,33 together. The connecting thread 16 is preferably made of twisted yarns (for example, of 600 denier) which are several times thicker than the foundation threads 24–27, 30–32. The parallel portions 17 of the connecting thread 16 traverse the wale-free region 15 every six courses in the illustrated embodiment. However, they may skip fewer or more courses depending on the thickness of yarn of a knit fabric to which the stringer 12 is to be attached and the thickness of knitting needles for use in such attachment.

Figure 3:
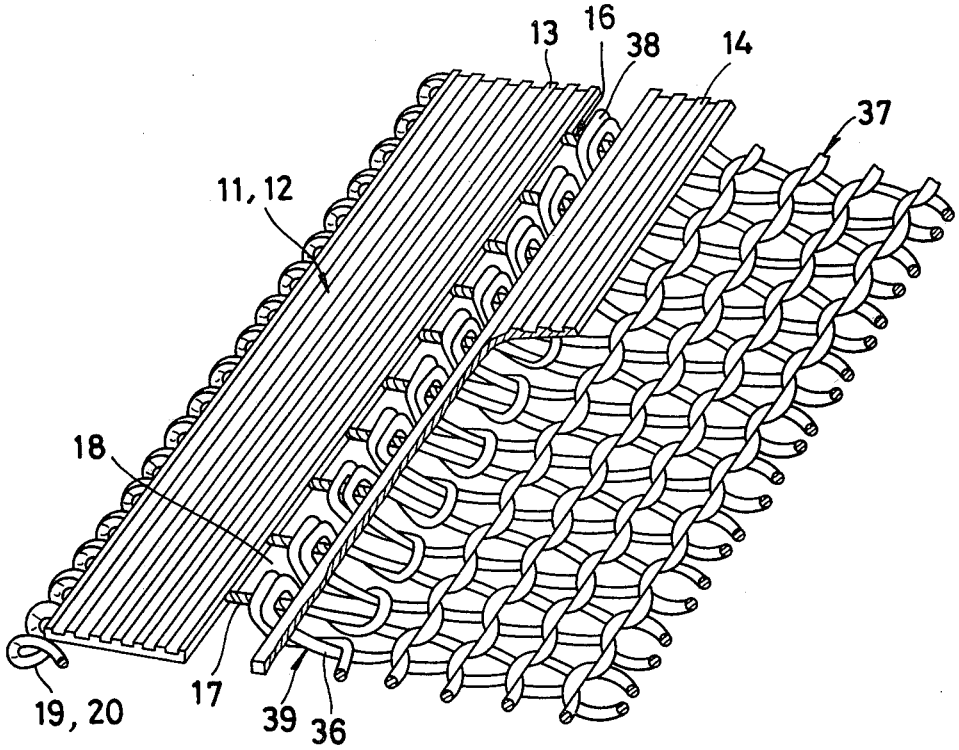
FIG. 3 is a fragmentary perspective view, partly broken away, of a slide fastener stringer knit into a knit fabric.

As shown in FIG. 3, the stringer tape 11,12 is knit into a knit fabric 37 of wool yarn including a row of loops 38 arranged along an edge or selvage 39 which represents a course 36, the loops 38 being looped around the parallel portions 17 of the connecting thread 16. Such knitting can be performed on an ordinary knitting machine for domestic use, having a row of knitting needles 40 (FIG. 4). More specifically, one of the stringer tapes 11 is first set on the knitting machine so that the knitting needles 40 extend through the openings 18 in the tape 11, and then a carriage (not shown) of the machine is operated to start knitting the fabric 37.

FIG. 5 illustrates another mode of attaching the stringer tape 11,12 to a knit fabric 42 of wool yarn. A row of loops 43*a* of wool yarn 43 or similar yarn such as embroidery yarn extends through the knit fabric 42 along a wale 41 thereof, the loops 43 projecting through the openings 18 and interlooped with a row of chain stitches 45 of wool yarn.

An ordinary knitting machine can perform such attachment. More specifically, the openings 18 in the tape 11,12 are first brought over latch needles of a knitting machine and then the interstices 44 along the wale 41 in the knit fabric 42 are brought over the needles. A carriage of the knitting machine which supplies the yarn 43 is operated to supply the needles with the yarn 43, which is pulled by the needles rearwardly of the stringer tape 11,12 through the interstices 44 in the knit fabric 42 and the openings 18 in the tape 11,12, thereby forming the row of loops 43*a*. The loops 43 *a* are then interlooped with the chain stitches 45 to fasten the stringer tape 11,12 to the knit fabric 42. The stringer tape 11,12 can be attached to the knit fabric 42 also on a linking machine.

With the web 14 being narrow, the latches on the knitting needles are movable without being caught in the web 14, thereby allowing smooth attachment of the stringer tapes to knit fabrics by knitting or stitching.

The stringer tape 11,12 can thus be attached to the knit fabric 37,42 by the loops 38 or loops 43 and stitches 45 of wool yarn that are linked to the parallel portions 17 of the connecting thread 16. The loops 38 or loops 43 and stitches 45 take up or damp forces applied from the knit fabric 37,42 to the stringer tape 11,12, which is less subjected to getting puckered or wavy. The loops 43 and stitches 45 may be differently colored so that they will appear distinct on the knit fabric 42 to render the resulting knit article impressive and attractive.

A warp-knit stringer tape 47 (FIG. 6) constructed according to another embodiment comprises a pair of warp-knit webs 48,49 with a wale-free region 50 therebetween, the webs 48,49 being interconnected by a connecting thread 51 laid in a pattern of 0-0/1-1/0-0/4-4/2-2/4-4. The web 48 includes a first group of foundation threads 52 knitted as chain stitches in a pattern of 1-0/0-1, a second group of foundation threads 54 laid in coursewise in a pattern of 0-0/4-4, and a third group of foundation threads 55 knitted in a pattern of 1-2/1-0, the foundation threads 52,53,55 constituting a plurality of wales juxtaposed across the web 48. The web 48 also has a fourth group of three foundation threads 53 laid in warpwise in a pattern of 0-0/1-1 to reinforce the marginal edge of the web 48 on which a row of coupling elements are to be mounted. A pair of outermost wales 56,57 include chain stitches that is thicker than the other foundation threads. The web 49 is composed of a fifth group of foundation threads 58 knitted as chain stitches of threads in a pattern of 1-0/0-1 and a sixth group of foundation threads 59 knitted in a pattern of 1-2/1-0, the web 49 including only a pair of wales and being narrower than the web 48. The fifth foundation thread 58 that constitutes one of the two wales which is remote from the web 48 is thicker than the other foundation thread. The wale-free region 50 is devoid of one wale.

Although various minor modifications might be suggested by those versed in the art, it should be understood that I wish to embody within the scope of the patent warranted hereon, all such embodiments as reasonably and properly come within the scope of my contribution to the art.

What is claimed is:

1. A slide fastener stringer for knit fabrics, comprising:

(a) a warp-knit stringer tape including a pair of longitudinal warp-knit webs spaced transversely from each other with a longitudinal wale-free region therebetween defined by confronting wales, each said web comprised of warp and weft threads, one of said warp-knit webs being narrower than the other wider warp-knit web, and a thread independent of said weft threads interconnecting said webs and having a pair of series of first and second longitudinal portions extending respectively in said wider and narrower warp-knit webs at longitudinal intervals, said first longitudinal portions lying only in one of said confronting wales, and substantially parallel adjacent portions all extending transversely across said wale-free region and spaced longitudinally at an equal interval, thereby defining a plurality of substantially rectangular openings longitudinally in and along said wale-free region; and (b) A row of coupling elements mounted on said wider warp-knit web remotely from said wale-free region; whereby loops of the knit fabric may be connected to said parallel portions of said thread.

2. A slide fastener stringer according to claim 1, said thread being made of twisted yarns.

3. A slide fastener stringer according to claim 1, said other wider web being composed of a first group of foundation threads knitted as chain stitches in a pattern of 1-0/0-1, a second group of foundation threads laid in coursewise in a pattern of 0-0/4-4, a third group of foundation threads knitted in a pattern of 1-2/1-0, and a fourth group of foundation threads laid in warpwise in a pattern of 0-0/1-1, said one narrower web being composed of a fifth group of foundation threads knitted as chain stitches in a pattern of 1-0/0-1, a sixth foundation thread laid in coursewise in a pattern of 0-0/4-4, and a seventh group of foundation threads knitted in a pattern of 1-2/1-0, and said interconnecting thread being laid in a pattern of 0-0/1-1/0-0/1-1/0-0/0-0/4-4/3-3/4-4/3-3/4-4/4-4.

4. A slide fastener stringer according to claim 1, said other wider web being composed of a first group of foundation threads knitted as chain threads in a pattern of 1-0/0-1, a second group of foundation threads laid in coursewise in a pattern of 0-0/4-4, a third group of foundation threads knitted in a pattern of 1-2/1-0, and a fourth group of foundation threads laid in warpwise in a pattern of 0-0/1-1, said one narrower web being composed of a fifth group of foundation threads knitted as chain stitches in a pattern of 1-0/0-1 and a sixth group of foundation threads knitted in a pattern of 1-2/1-0, and said interconnecting thread being laid in a pattern of 0-0/1-1/0-0/4-4/2-2/4-4.

5. A slide fastener stringer according to claim 1, said one narrower web comprising four wales.

6. A slide fastener stringer according to claim 1, said one narrower web comprising two wales.

7. A slide fastener stringer according to claim 1, said wale-free region being devoid of only one wale.

8. A knit article comprising:

(a) a knit fabric;

(b) a warp-knit slide fastener stringer tape including a pair of longitudinal warp-knit webs spaced transversely from each other with a longitudinal wale-free region therebetween defined by confronting wales, each said web composed of warp and weft threads, one of said warp-knit webs being narrower than the other wider warp-knit web, and a thread independent of said weft threads interconnecting said webs and having a pair of series of first and second longitudinal portions extending respectively in said wider and narrower warp-knit webs at longitudinal portions lying only in one of said longitudinal intervals, said first confronting wales, and substantially parallel adjacent portions all extending transversely across said wale-free region and spaced longitudinally at an equal interval, thereby defining a plurality of substantially rectangular openings longitudinally in and along said wale-free region a row of thread loops looping about said parallel portions by which said tape is connected to said knit fabric; and (c) a row of coupling elements mounted on said other wider warp-knit web remotely from said wale-free region.

9. A knit article according to claim 8, said loops being constituted by a course of said knit fabric and being looped respectively around said parallel portions of the thread.

10. A knit article according to claim 9, said course extending along a selvage of said knit fabric.

11. A knit article according to claim 8, said loops extending through said knit fabric along a wale thereof into said openings in the stringer tape, including a row of chain stitches interlooped with said loops projecting through said openings.

12. A knit article according to claim 8, said knit fabric and said loops being made of wool yarn.

* * * * *

UNITED STATES PATENT AND TRADEMARK OFFICE

CERTIFICATE OF CORRECTION

PATENT NO. : 4,442,685

DATED : April 17, 1984

INVENTOR(S) : Yoshio Matsuda

It is certified that error appears in the above—identified patent and that said Letters Patent is hereby corrected as shown below:

On the cover page, correct the name of the inventor to read --Yoshio Matsuda--.

Signed and Sealed this

*Twelfth* Day of *March 1985*

[SEAL]

*Attest:*

DONALD J. QUIGG

*Attesting Officer*

*Acting Commissioner of Patents and Trademarks*